US007332686B2

(12) United States Patent
Parnell

(10) Patent No.: US 7,332,686 B2
(45) Date of Patent: Feb. 19, 2008

(54) REMOTE CONTROL ELECTRICAL SWITCH

(75) Inventor: Richard Erle Parnell, 1989 Higby Dr., Stow, OH (US) 44224

(73) Assignee: Richard Erle Parnell, Stow, OH (US)

( * ) Notice: Subject to any disclaimer, the term of this patent is extended or adjusted under 35 U.S.C. 154(b) by 0 days.

(21) Appl. No.: 11/395,787

(22) Filed: Mar. 31, 2006

(65) Prior Publication Data

US 2007/0227870 A1 Oct. 4, 2007

(51) Int. Cl.
*H01H 3/20* (2006.01)

(52) U.S. Cl. ..... 200/331; 200/330

(58) Field of Classification Search ..... 200/329, 200/330, 331–339, 341, 520, 523, 564–572, 200/51 R, 311–317
See application file for complete search history.

(56) References Cited

U.S. PATENT DOCUMENTS 3,970,984 A * 7/1976 Grubenmann ..... 338/153
4,104,606 A 8/1978 DeWitt
4,109,231 A 8/1978 Krouse
4,242,551 A * 12/1980 Sorenson ..... 200/302.3
4,672,234 A 6/1987 Breining et al.
5,132,498 A 7/1992 Lee
6,036,330 A * 3/2000 Sanguedolce ..... 362/95
6,051,801 A 4/2000 Wang
6,410,870 B1 6/2002 Nishizaki et al.
6,590,176 B2 * 7/2003 Cole et al. ..... 200/341
6,703,786 B2 3/2004 Tannenbaum
6,710,274 B2 * 3/2004 Whetzel et al. ..... 200/330
6,715,902 B1 4/2004 Herring
6,802,741 B1 10/2004 Shatkin
6,878,889 B1 4/2005 Horst
6,969,811 B1 11/2005 Lai
6,979,787 B2 12/2005 Davies

OTHER PUBLICATIONS

Touch Pad Dimmer (Jan. 4, 2006) Downloaded from: http://www.eztone.com/lighting-touch-control.htm.
Outdoor Cord With IN-Line Switch KB-11 (Kintron Oct. 17, 2003) (Website: www.kintron.com).
Picture of Agate Table Lamp Switch, marked Exhibit "D" (circa 1950's, 1960's).
Picture of Table Lamp Switch, marked Exhibit "E" (circa 1950's, 1960's).

* cited by examiner

*Primary Examiner*—Elvin Enad
*Assistant Examiner*—M. Fishman
(74) *Attorney, Agent, or Firm*—Amin, Turocy & Calvin, LLP

(57) ABSTRACT

A remote control electrical switch with omnidirectional access provides remote control of electrically connected devices. The remote control electrical switch allows electrical devices to be controlled with minimal physical dexterity, easing the physical efforts required for typical electrical switching devices. A 360 degree switch access allows users to approach the remote control electrical switch from any direction to further facilitate its ease-of-use. A top portion of the remote control electrical switch provides a switch activation leverage area that rests on a switch fulcrum point, allowing activation of the switch via force applied to any point of the switch actuation surface. Instances of the switching mechanism can also include an illumination source to indicate the status of the remote control electrical switch from a visual perspective and/or to provide location of the switching mechanism in ambient light deficient areas. The illumination source can be implemented to provide omnidirectional illumination.

27 Claims, 12 Drawing Sheets

300

1200

REMOTE CONTROL ELECTRICAL SWITCH

CROSS-REFERENCE TO RELATED APPLICATION

This application is related to U.S. patent application Ser. No. 29/257,300 filed on Mar. 31, 2006, entitled "REMOTE CONTROL ELECTRICAL SWITCH."

BACKGROUND

Electricity has long been accepted as a necessary part of our daily lives. We constantly increase our reliance on it and have grown so accustomed to it that power outages can often cause great hardships to modern civilization. However, redundancies in power production and energy systems have eliminated such outages to an almost nonexistent occurrence. Thus, it has become an increasingly reliable energy source that is harnessed in many different ways and channeled safely to our homes. Once there, it is utilized to ease burdens and to provide the necessities of life—heating, cooling, lighting, and even food preparation and preservation to name but a few. This source of energy has an amazing property in that it can be sized to fit the task at hand—powering megawatt machinery in industrial complexes down to electric toothbrushes in our homes—in a safe and convenient manner. Anyone who has attempted to manually start a gasoline engine on a lawn mower can appreciate the effortless starting of an electric start one where all of the tugging and pulling is reduced to a mere push of a button or a twist of a key.

Today's homes are filled with electrical devices such as clothes dryers, electric stoves, microwaves, coffee makers, toasters, lights, televisions, hair dryers, fans, heaters, air conditioners, computers, printers, scanners, dishwashers, washing machines, food processors, and other endless devices that harness electricity to aid our lives. All of these devices work because the electricity makes them easily controllable by just interrupting the flow of electricity. Big and small devices alike can be started and stopped with a mere flick of a switch that controls the electrical power to the device—no longer is the amount of effort required to control the device proportional to the amount of work that the device performs—a turn of a key in an ignition switch can start a lawn mower or start a bulldozer. This has helped to equalize the physical prowess required to control devices. As long as a person is capable of pushing a button, flicking a switch, or twisting a key, an electrical device can be manipulated.

Unfortunately for many people, the dexterity required for even these simple tasks is not within their capabilities. Although for many it might seem trivial to twist a key, elderly people or those with joint debilitating diseases such as arthritis or lupus, for example, might not be able to even perform that simplistic act. Others also might not have the limbs necessary to perform those types actions—amputees or those with birth defects can be without appendages that are required to perform acts such as twisting a key or reaching a wall light switch. Their lives and the devices around them have to be adjusted so that, if possible, they can regain control of those devices. This is usually costly because it requires that modifications be made to the devices and how they are controlled. Many people with disabilities are typically on limited incomes and cannot afford such expenditures even if it would ease some of their daily burdens. Electrical devices provide powerful tools for easing hardships, and those with disabilities or other encumbrances should not be without those conveniences because of the effort and high cost of modifying their controls.

SUMMARY

The following presents a simplified summary of the subject matter in order to provide a basic understanding of some aspects of subject matter embodiments. This summary is not an extensive overview of the subject matter. It is not intended to identify key/critical elements of the embodiments or to delineate the scope of the subject matter. Its sole purpose is to present some concepts of the subject matter in a simplified form as a prelude to the more detailed description that is presented later.

A remote control electrical switch with omnidirectional access provides remote control of electrically connected devices. The remote control electrical switch allows electrical devices to be controlled with minimal physical dexterity, easing the physical efforts required for standard electrical switching devices. A 360 degree switch access allows users to approach the switching mechanism from any direction to further facilitate its ease-of-use. Instances of the remote control electrical switch can also include an illumination source to indicate the status of the remote control electrical switch from a visual perspective and/or to provide location of the switching mechanism in ambient light deficient areas and the like. The illumination source can be implemented to provide omnidirectional illumination.

Activation of the remote control electrical switch is accomplished by applying minimal force on any point of a top surface of the remote control electrical switch. The top portion of the remote control electrical switch provides a switch activation leverage area that rests on a switch fulcrum point, allowing activation of the switch via force applied to any point of the switch actuation surface. The easy access and minimal activation force allow the switching mechanism to be easily utilized by the elderly, users with dexterity disabilities, and/or children and the like.

To the accomplishment of the foregoing and related ends, certain illustrative aspects of embodiments are described herein in connection with the following description and the annexed drawings. These aspects are indicative, however, of but a few of the various ways in which the principles of the subject matter may be employed, and the subject matter is intended to include all such aspects and their equivalents. Other advantages and novel features of the subject matter may become apparent from the following detailed description when considered in conjunction with the drawings.

DETAILED DESCRIPTION

Figure 1:
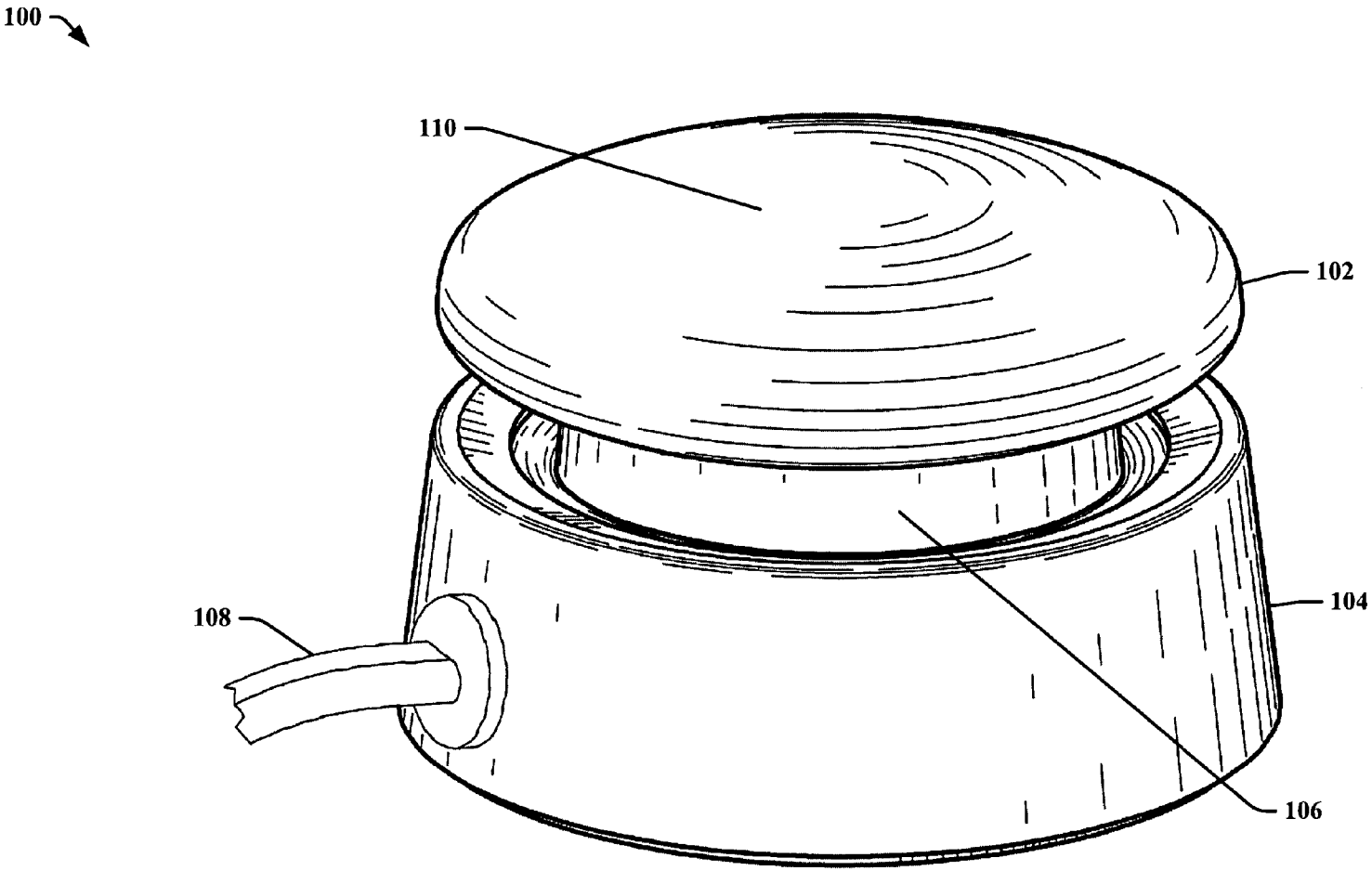
FIG. 1 is an illustration of an instance of a remote control electrical switch in accordance with an aspect of an embodiment.

The subject matter is now described with reference to the drawings, wherein like reference numerals are used to refer to like elements throughout. In the following description, for purposes of explanation, numerous specific details are set forth in order to provide a thorough understanding of the subject matter. It may be evident, however, that subject matter embodiments may be practiced without these specific details. In other instances, well-known structures and devices are shown in block diagram form in order to facilitate describing the embodiments.

Oftentimes, a high level of dexterity is required to turn electrical devices ON and OFF. This level of dexterity might be impossible for some people due to disabilities or come at a very painful cost to those suffering from arthritis and the like. The subject matter disclosed herein provides instances that facilitate in alleviating the discomfort and/or inconvenience required of actuating typical switches for electrical devices. Other instances can also permit people with disabilities to perform remote control of electrical devices that is otherwise impossible without those instances. Because of the ease of use, instances can also be employed as a convenient device to remotely control electrical devices. The force required to activate instances are minimal and can even be performed by animals and the like. For example, guide or assistance animals, such as guide dogs, can be trained to easily actuate instances of the remote control electrical switch provided herein, easily performing tasks that their owners may not be able to perform. Thus, these instances can greatly enhance the quality of life for people who would otherwise be constantly dependent on others to help them accomplish seemingly simple tasks.

Because of the low force, mobility, and smooth operation, instances of a remote control electrical switch disclosed herein are also extremely beneficial to users without any type disability. The large, unencumbered switch actuation area of instances of the remote control electrical switch enables very convenient switch activation with a smooth tactile feel that is greatly preferred over typical switches found on most electrical devices. Thus, instances of the remote control electrical switch provide an "upgrade" to these electrical devices to make them easier to control and more convenient without requiring expensive replacements of the devices themselves.

In FIG. 1, an illustration of an instance of a remote control electrical switch 100 in accordance with an aspect of an embodiment is shown. The remote control electrical switch 100 is comprised of a pivotable switch actuator cap 102, a base 104, a connecting ring 106, and an electrical cord 108. The connecting ring 106 is affixed to the pivotable switch actuator cap 102 and retained by the base 104. This allows the connecting ring 106 to pivot with the pivotable switch actuator cap 102 while preventing the pivotable switch actuator cap 102 from becoming separated from the base 104. In other instances, the pivotable switch actuator cap 102, the base 104, and/or the connecting ring 106 can be produced from translucent materials to provide illumination. The pivotable switch actuator cap 102 provides a large actuation surface 110 for a switching mechanism (not illustrated in FIG. 1, described infra) inside the base 104. Although the actuation surface 110, the pivotable switch actuator cap 102, the connecting ring 106, and the base 104 are depicted in FIG. 1 as being circular in nature, one skilled in the art can appreciate that the functionality of the remote control electrical switch 100 is not impaired if other geometric shapes are employed for any part of the remote control electrical switch, such as rectangles, squares, and/or pentagons and the like, and are within the scope of the subject matter herein.

Because the actuation surface 110 is large, the switching mechanism can be activated with minimal force applied to the pivotable switch actuator cap 102. A force applied to a portion of the pivotable actuator switch cap 102 is transferred, in some proportion, to the switching mechanism. This allows a user to approach the remote control electrical switch 100 from any direction and easily applying force to the pivotable switch actuator cap 102. Because of the large actuation surface 110, it is easy to visualize those with debilitating handicaps utilizing the remote control electrical switch 100. A palm of a hand, an elbow, a forearm, and/or other body part and the like can be employed to activate the remote control electrical switch 100. Even a guide dog, for example, could easily apply enough force to activate the remote control electrical switch 100.

The remote control electrical switch 100 is easily moved from one location to another. This allows it 100 to be placed within easy reach, despite the actual placement of an electrical device that is being controlled. In a typical usage scenario, the electrical cord 108 has a piggy-back style plug at one end (not shown, see FIG. 11) and is plugged into an electrical outlet. An electrical device that a user would like to control is then plugged into the back of the piggy-back style plug. Thus, the remote control electrical switch 100 becomes part of the electrical path, in a serial fashion, for the electrical device plugged into it 100. One skilled in the art can appreciate that other means of electrically connecting the remote control electrical switch 100 to an electrical device, such as hardwiring and the like, are possible and are within the scope of the subject matter herein. The remote control electrical switch 100 can also provide remote switching control for more than one electrical device at substantially the same time.

Although the remote control electrical switch 100 is shown as a horizontally utilized device in FIG. 1, other instances can be utilized in a vertical plane as well. This allows the remote control electrical switch 100 to be mounted to a wall and the like and be activated by forces in a horizontal plane. This substantially increases the utility of the remote control electrical switch 100. For example, the remote control electrical switch 100 can be affixed at waist height and activated with an available body part and/or other convenient extension. The remote control electrical switch 100 can even be mounted behind a door so that a portion of the door activates the remote control electrical switch 100 when the door is opened and the like. If located lower to the floor, the remote control electrical switch 100 can be easily activated by a foot and the like. The remote control electrical switch 100 can also be utilized by placing it on a floor and activated.

Figure 2:
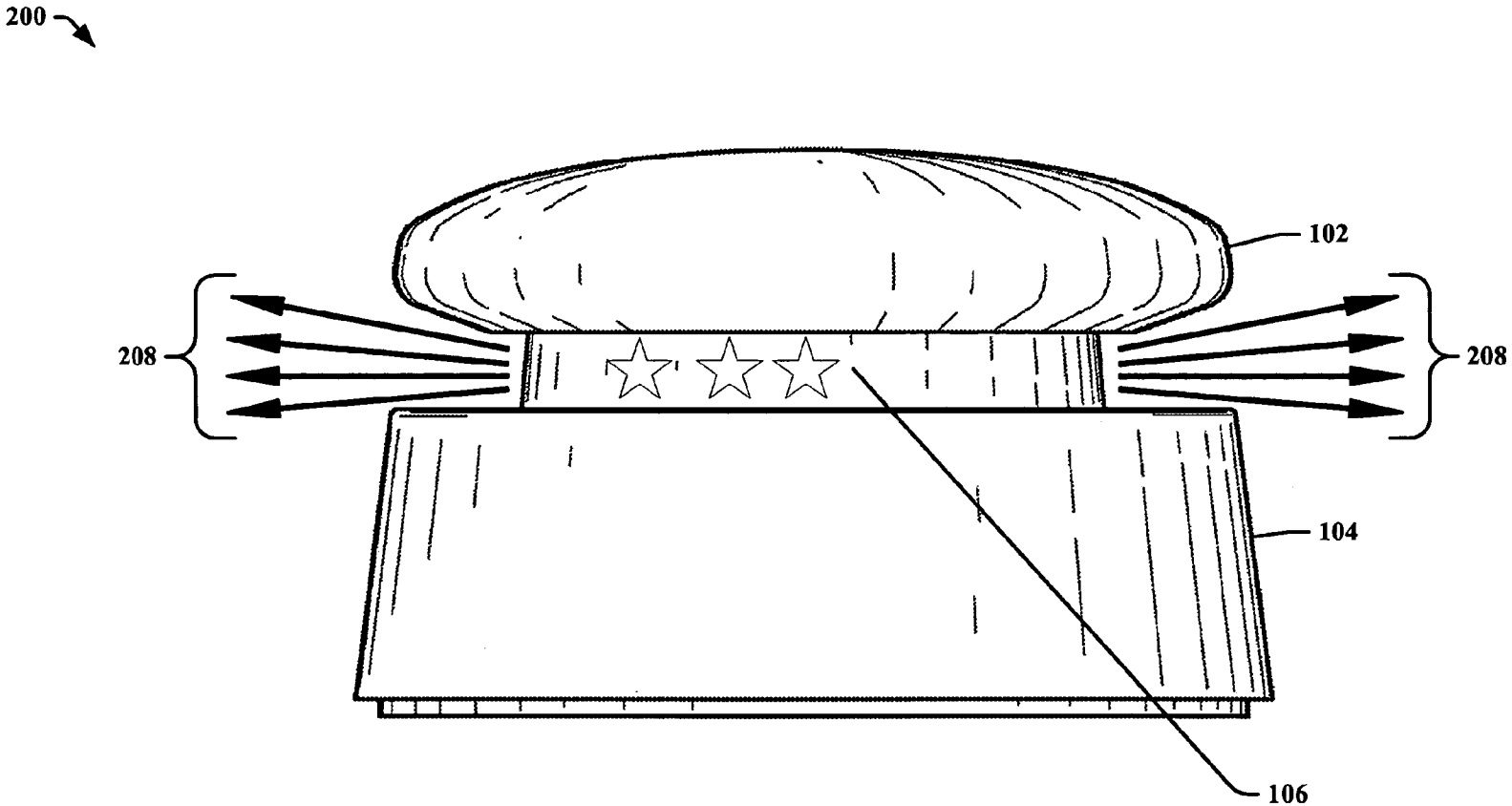
FIG. 2 is an illustration of an instance of a remote control electrical switch with 360 degrees of illumination in accordance with an aspect of an embodiment.

Looking at FIG. 2, an illustration of an instance of a remote control electrical switch 200 with 360 degrees of illumination in accordance with an aspect of an embodiment is depicted. The remote control electrical switch 200 is comprised of a pivotable switch actuator cap 102, a base 104, and a connecting ring 106. In this instance, the connecting ring 106 is comprised of translucent material that allows the remote control electrical switch 200 to provide 360 degrees of illumination (represented by arrows 208). In one instance, the illumination is provided to indicate an operational state of the remote control electrical switch 200. For example, illumination can be provided when an attached electrical device is energized. This can be useful, for example, when the electrical device is in one room and the remote control electrical switch 200 is in another room and/or if an electrical device is located in an exterior location and is not easily visible.

In another instance, the remote control electrical switch 200 illuminates to indicate when an attached electrical device is de-energized. This allows the remote control electrical switch 200 to provide both a status indication (device OFF) and to provide a locating beacon so that a user can easily find the remote control electrical switch 200 in light deprived areas. This is especially useful when the remote control electrical switch 200 is controlling an illuminating device such as a table top lamp and/or a floor lamp and the like that is the only source of illumination in a room. Thus, a user can locate the remote control electrical switch 200 easily in a darkened room and quickly switch on room lighting.

In yet another instance, the remote control electrical switch 200 can be comprised of a partially translucent connecting ring 106. This allows the connecting ring 106 to emanate light in a controlled fashion, allowing various shapes and/or symbols to be illuminated. This can substantially enhance the remote control electrical switch 200 because it can be employed, not only as a decorative feature, but also to indicate what the remote control electrical switch 200 is controlling and the like. For example, the connecting ring 106 can be utilized to spell out "LAMP" and/or "FAN" and the like so that a user can visually determine what the remote control electrical switch 200 is controlling. This is especially helpful in situations where more than one remote control electrical switch 200 is being utilized and/or when the remote control electrical switch 200 is utilized by more than one user who might be unfamiliar with its purpose. For decorative purposes, the illumination could be utilized to form hearts, snowflakes, Christmas trees, and other objects for seasonal and/or special occasions and the like.

Other instances of the remote control electrical switch 200 can employ different light wavelengths (e.g., colors) to enhance aesthetics and/or to facilitate in identifying its 200 function (e.g., controlling a fan, light, etc.). For example, red illumination can indicate that it 200 is controlling a fan and/or blue illumination can indicate that it 200 is connected to a floor lamp and the like. In a similar fashion, the illumination wavelength can indicate an operational state of the remote control electrical switch 200. Red illumination can indicate that a controlled electrical device is OFF and green illumination can indicate that a controlled device is ON and the like.

Still yet other instances can employ multiple illumination wavelengths to facilitate both aesthetics and/or functionality of the remote control electrical switch 200. Similarly, the illumination can be steady state and/or possess a duty cycle for aesthetics and/or functionality reasons. For example, a slowly flashing remote control electrical switch 200 can indicate that a device is de-energized and a steady remote control electrical switch 200 can indicate an energized device. Utilizing this technique, a user can induce an action by another, for example, by placing a bright strobing remote control electrical switch 200 in a room. Most people would react to the strobing by attempting to turn off the remote control electrical switch 200. When the remote control electrical switch 200 is turned OFF, a large fan could be energized or a bright light could flash to illicit a desired response from the unsuspecting user.

Figure 3:
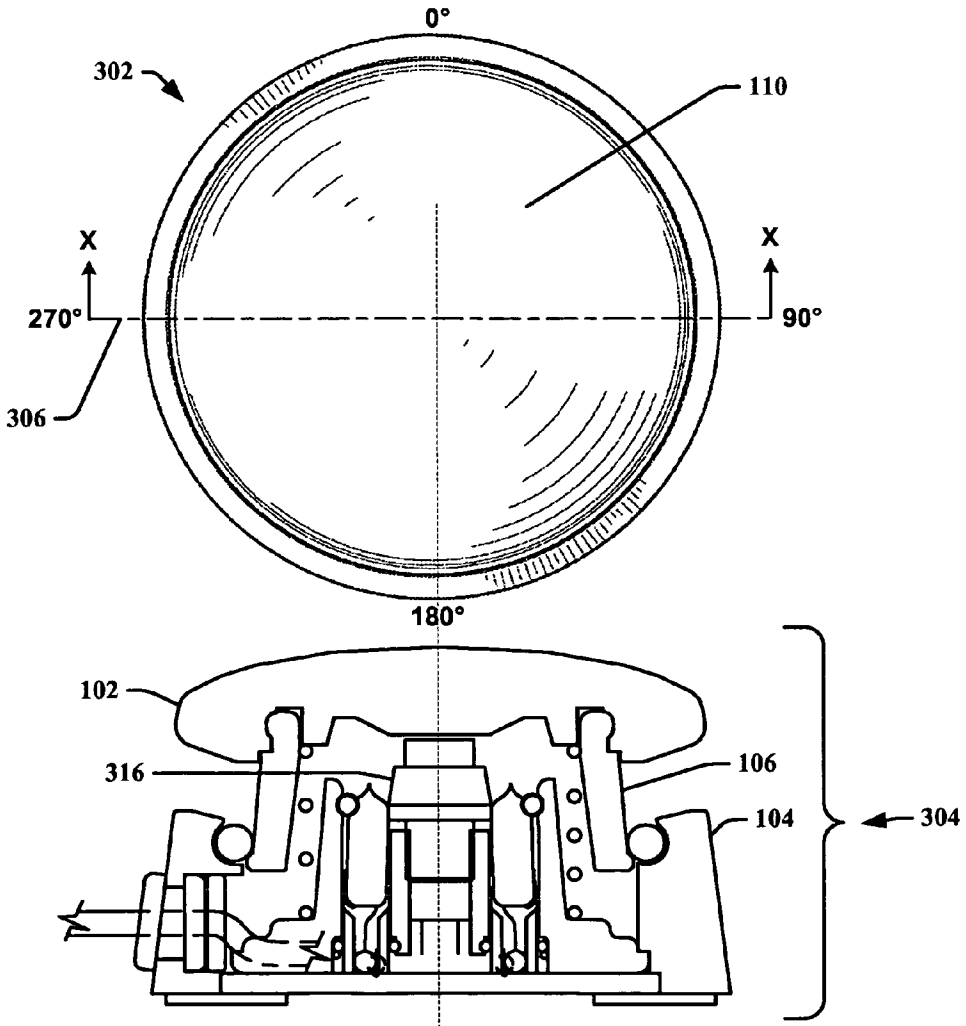
FIG. 3 is a plan view of an instance of a remote control electrical switch in accordance with an aspect of an embodiment.

Turning to FIG. 3, a plan view 300 of an instance of a remote control electrical switch in accordance with an aspect of an embodiment is illustrated. The plan view 300 consists of a top view 302 with a plane X-X 306 upon which a sectional view 304 is taken. The top view 302 illustrates an actuation surface 110 provided by a pivotable switch actuator cap 102. The sectional view 304 further illustrates a base 104, a connecting ring 106, and a switch mechanism 316. The plan view 300 demonstrates the relation of the actuation surface 110 to the switch mechanism 316. The switch mechanism 316 is substantially centered in relationship to the actuation surface 110 to provide substantially similar switch activation response independent of an approach angle of a user. This allows the pivotable switch actuator cap 102 to induce substantially similar force on the switch mechanism 316 whether, for example, a user applies force on the actuation surface 110 at 0 degrees, 90 degrees, 180 degrees, or 270 degrees and the like. Note that a user can also apply force to a center area of the actuation surface 110 and activate the switch mechanism 316. Thus, the switch mechanism 316 provides a depressible switching fulcrum for the pivotable switch actuator cap 102.

Figure 4:
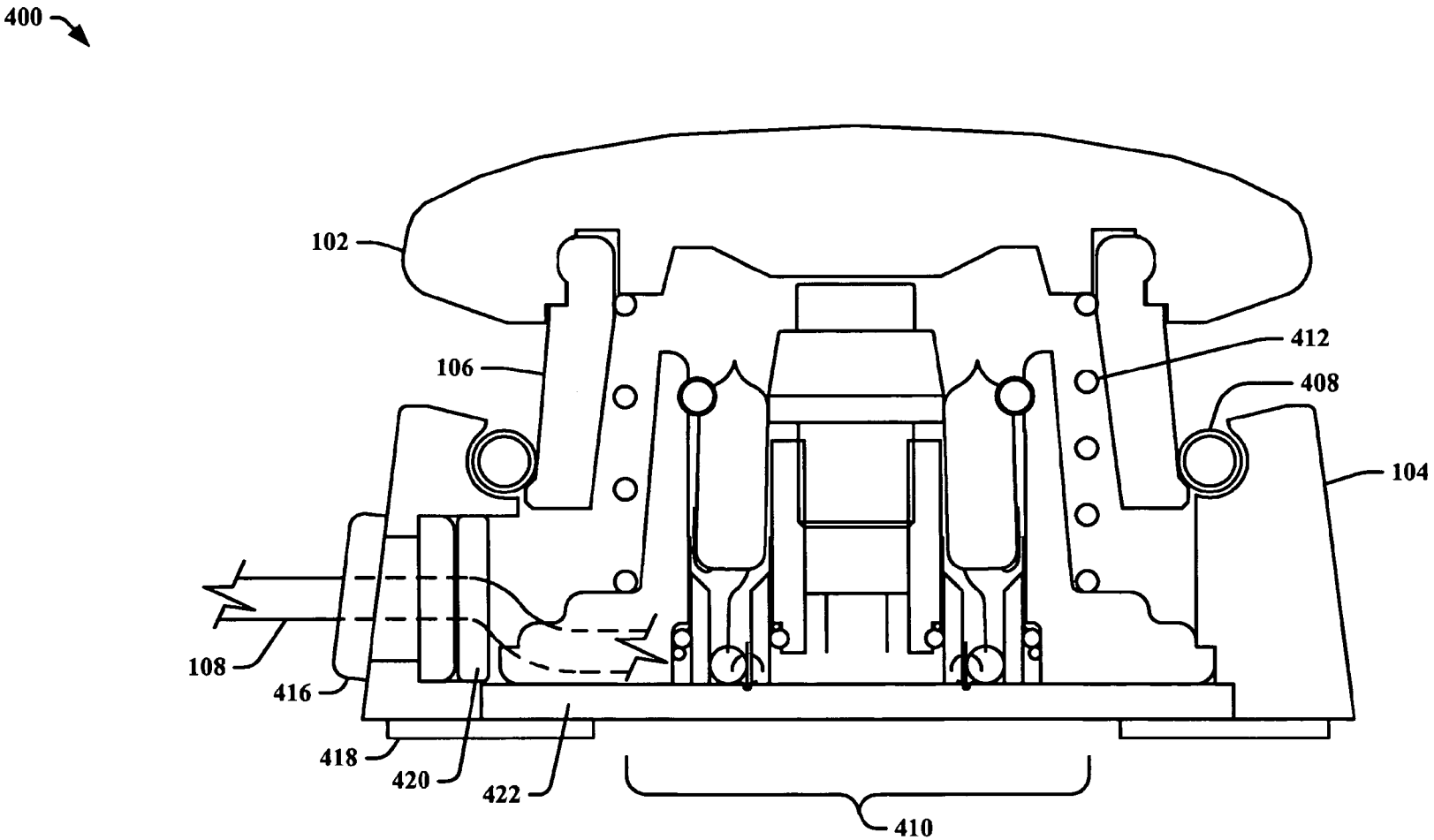
FIG. 4 is a sectional view of an instance of a remote control electrical switch in accordance with an aspect of an embodiment.

Moving on to FIG. 4, a sectional view of an instance of a remote control electrical switch 400 in accordance with an aspect of an embodiment is shown. The remote control electrical switch 400 is comprised of a pivotable switch actuator cap 102, a base 104, a connecting ring 106, a connecting ring retention device 408, a switch post assembly 410, a spring 412, an electrical cord 108, a cord grommet 416, an optional anti-skid pad 418, a cord retention device 420, and an optional base access plate 422. The pivotable switch actuator cap 102 interlocks with the connecting ring 106. This allows the pivotable switch actuator cap 102 and the connecting ring to move in unison in response to user force applied to the pivotable switch actuator cap 102. The connecting ring 106 is retained by the base 104 via the connecting ring retention device 408. The connecting ring retention device 408 interlocks with the base 104 and inhibits the connecting ring 106 from separating from the base 104 while still allowing the connecting ring 106 to move freely within the base 104.

The base 104 can be comprised of a single piece or multiple pieces and can also have the optional base access plate 422. The optional base access plate 422 enables easier access to the switch post assembly 410 and/or facilitates in assembly of the remote control electrical switch 400. The switch post assembly 410 can contain consumable parts (e.g., an illumination source such as a bulb and the like, etc.) that can be replaced via the optional base access plate 422. The spring 412 applies opposing forces to the pivotable switch actuator cap 102 and the base 104 via the switch post assembly 410 in this instance. The spring 412 provides rebounding force to the pivotable switch actuator cap 102 after switch activation by a user.

The electrical cord 108 connects in serial to an electrical source and an electrical device at one end (not shown) and enters through a hole in the base 104 via the cord grommet 416 to electrically connect with the switch post assembly 410. The entry point of the electrical cord 108 can vary in different instances. The cord retention device 420 prevents the electrical cord 108 from being pulled and applying force to the connection with the switch post assembly 410. The cord grommet 416 and/or the cord retention device 420 are not required for functionality but are generally considered safety devices that reduce shock hazards. Thus, they are not necessary for proper operation of the remote control electrical switch 400. The switch post assembly 410 is described in detail infra.

Figure 5:
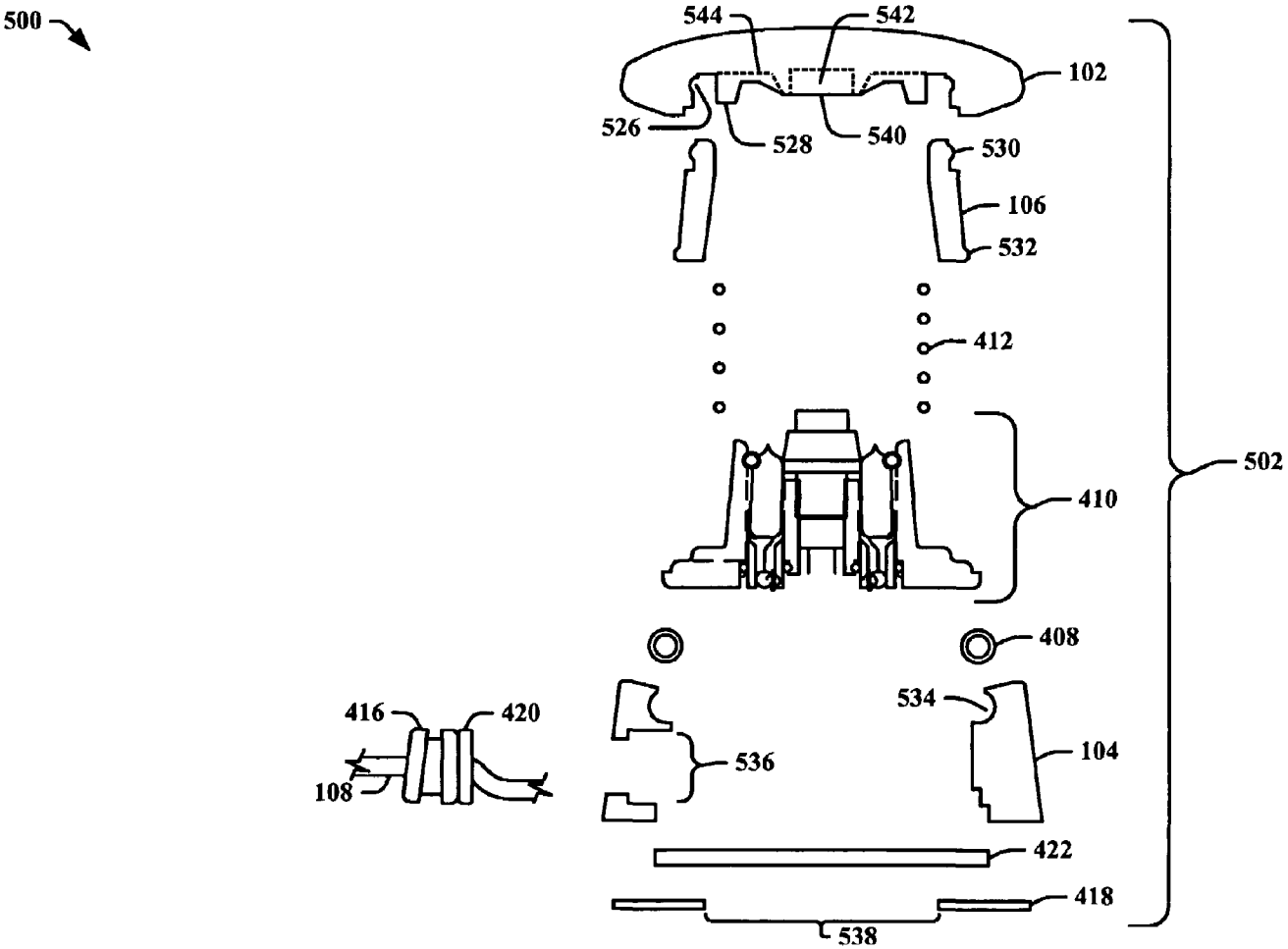
FIG. 5 is an exploded view of an instance of a remote control electrical switch in accordance with an aspect of an embodiment.

In FIG. 5, an exploded view 500 of an instance of a remote control electrical switch 502 in accordance with an aspect of an embodiment is depicted. The remote control electrical switch 502 is comprised of a pivotable switch actuator cap 102 a connecting ring 106, a spring 412, a switch post assembly 410, a connecting ring retention device 408, a base 104, an optional base access plate 422, an optional anti-skid pad 418, an electrical cord 108, a cord grommet 416, and a cord retention device 420. The pivotable switch actuator cap 102 can be constructed of a durable material and manufactured, for example, by injection molding and/or gravity molding and the like. In one instance, liquid polyurethane is utilized in a gravity molding process where it is poured into the mold at room temperature and then pressure is applied to minimize air in the polyurethane. It 102 can be a solid color and/or multiple colors and/or textures. A smooth texture is generally inviting to the touch and is preferred by most users. However, the pivotable switch actuator cap 102 can also have a rough texture and/or an identifying texture.

An identifying texture can include, but is not limited to, textures that can be employed to indicate to a user which electrical device is controlled by the remote control electrical switch 502. This is especially useful, for example, for sight-impaired users who might have more than one remote control electrical switch 502 to control multiple electrical devices. The user, in this example, might desire to turn on a fan when they are alone, but they would also desire to have the ability to turn on lights when company is present. An identifying texture, such as Braille and/or raised and/or embossed/debossed symbols, can facilitate a sight-impaired user and/or other users to correctly identify the proper remote control electrical switch 502. Likewise, the pivotable switch actuator cap 102 can also be manufactured partially and/or completely of translucent material. This allows illumination from the top of the remote control electrical switch 502 and can facilitate use of it 502 when it 502 is placed at a lower level in relation to a user's line-of-sight. Thus, symbols, letters, objects, and the like can be illuminated and visually interpreted by a user viewing from a higher angle.

The pivotable switch actuator cap 102 is formed such that a substantially circular groove 526 is formed in a lower portion. This allows the connecting ring 106 to interlock with the pivotable switch actuator cap 102. The interlocking force is sufficient to keep the connecting ring 506 106 and the pivotable switch actuator cap 102 in unison during normal operation of the remote control electrical switch 502. In this instance, the pivotable switch actuator cap 102 also has a spring contact surface 528 and a switch mechanism contact surface 540. In other instances, an alternate profile 544 can be utilized as the spring contact surface 528. In some instances, the connecting ring 106 can facilitate in inhibiting outward expansion of the spring 412 and/or in maintaining alignment of the spring 412. An optional switch mechanism contact surface plug 542 can also be utilized in some instances. The optional switch mechanism contact surface plug 542 can provide an enhanced switch mechanism contact surface 540. It 542 allows different materials to be utilized for the switch mechanism contact surface 540 rather than relying on the material of the pivotable switch actuator cap 102. Thus, for example, wear-resistant materials, cushioned materials, and/or low-friction materials and the like can be employed for the optional switch mechanism contact surface plug 542.

The connecting ring 106 can be manufactured from opaque and/or translucent material as noted supra. Manufacturing processes can include injection molding and/or gravity molding and the like In one instance, liquid polyurethane is utilized in a gravity molding process where it is poured into the mold at room temperature and then pressure is applied to minimize air in the polyurethane. Similar to the pivotable switch actuator cap 102 the connecting ring 106 can be formed to illuminate with or without symbols, characters, objects, and the like. The connecting ring 106 can utilize translucent materials that also alter the wavelength of transmitted light. This allows it 106 to change colors of an internal light source. Since the connecting ring 106 interlocks with the pivotable switch actuator cap 102 it 102 can be removed by a user and replaced with various colored connecting rings in order to alter its aesthetics and/or its functionality. For example, a user might prefer green illumination and/or a user might utilize green to indicate that an electrical device is energized and the like. Thus, the connecting ring 106 (and/or even the pivotable switch actuator cap 102) can be made available as a user replacement accessory, both for utility purposes and/or for decorative purposes. The connecting ring 106 has a circular embossed ring 530 at its upper portion that allows it 106 to interlock with the pivotable switch actuator cap 102. A lower portion of the connecting ring 106 has a retaining lip 532 that interacts with the connecting ring retention device 408 to facilitate retention of the connecting ring 106 within the base 104. The connecting ring 106 itself can be substantially cylindrical in shape and/or it 106 can taper inward such that the lower portion is wider than the top portion. The tapering can facilitate ease-of-movement of the connecting ring 106 within the base 104 when the pivotable switch actuator cap 102 is depressed.

The spring 412 applies opposing forces to the pivotable switch actuator cap 102 and the base 104 via the switch post assembly 410. The spring 412 provides a rebounding force to the pivotable switch actuator cap 102 after switch activation by a user. The compression force of the spring 412 can be adjusted to facilitate in reducing an amount of force necessary to depress the pivotable switch actuator cap 102. Likewise, the rebounding force of the spring 412 can be adjusted as necessary to provide smooth operation of the remote control electrical switch 502. The switch post assembly 410 provides a mount for a switching mechanism and illumination sources if applicable. It 410 is described in more detail infra.

The base 104 can be manufactured from the same materials as the pivotable switch actuator cap 102 and/or other materials. It 104 is generally manufactured with an injection mold process and/or gravity mold process and the like. In one instance, liquid polyurethane is utilized in a gravity mold process where it is poured into the mold at room temperature and then pressure is applied to minimize air in the polyurethane. The base 104 has a circular base groove 534 with a radius substantially similar to the connecting ring retention device 408. The connecting ring retention device 408 is typically formed of a semi-flexible material such as, for example, polyethylene tubing and the like. It 408 is not required to be tubular in structure and rod-like structures are equally viable. The connecting ring retention device 408 seats within the circular base groove 534 and substantially inhibits separation of the base 104 and the connecting ring 106. The force required for separation of the base 104 and the connecting ring 106 are sufficient to prevent separation during normal usage of the remote control electrical switch 502 but, in some instances, can also be of a low enough force level that users can forcefully separate the connecting ring 106 and the base 104 to perform consumable replacements, upgrades, and/or decorative changes and the like. The compression factor of the connecting ring retention device 408 and/or the prominence of the retaining lip 532 of the connecting ring 106 can alter the amount of required separation force.

The base 104 also serves to house the switch post assembly 410 and provide a contained area for electrical connections. In some instances, an optional base access plate 422 can be provided to facilitate in replacing consumables (e.g., lighting sources, etc.) and the like. However, the base 104 can also be manufactured without the optional base access plate 422. Typically, a hole 536 is provided in a side of the base 104 to allow the electrical cord 108 to pass through the base 104. However, it is not required that the electrical cord 108 enter the base 544 104 through the side. It 108 can also enter the base 104 from the bottom. This is more practicable with other instances where the base 104 can have some type of elevating feet that can allow the electrical cord 108 to easily pass under the base 104 and through the bottom. The cord grommet 416 is not necessary for the functionality of the remote control electrical switch 502 but provides chafing and other safety guards typically required by electrical codes and/or standards. The cord grommet 416 is typically manufactured of rubber and/or plastic material and the like that is nonconductive.

Likewise, the cord retention device 420 is also not required for functionality of the remote control electrical switch 502 but provides a safety feature in preventing external force on the electrical cord 108 from being applied to electrical connections within the base 104. The cord retention device 420 is typically constructed of material that can be permanently formed into a desired shape. This includes metals and/or other hard formed plastics and the like that can provide a clamping force onto the insulation of the electrical cord 108. One such device is often referred to as a "hog ring."

The optional anti-skid pad 418 is typically affixed to the base 104 and/or the optional base access plate 422. It 418 inhibits undesired movement of the remote control electrical switch 502. The optional anti-skid pad 418 is typically manufactured from soft rubber and/or other materials that provide a natural adhesion to surfaces such as glass and/or wood and the like. This adhesive force is sufficient to prevent undesired movement, but not enough to prevent easy lifting and/or relocation of the remote control electrical switch 502. In this instance, the optional anti-skid pad 418 is circular in shape with a center cut-out 538. However, other instances can utilize the optional anti-skid pad 418 without requiring the center cut-out 538. Still yet other instances do not employ the anti-skid pad 418 as it 418 is not required for the functionality of the remote control electrical switch 502.

Figure 6:
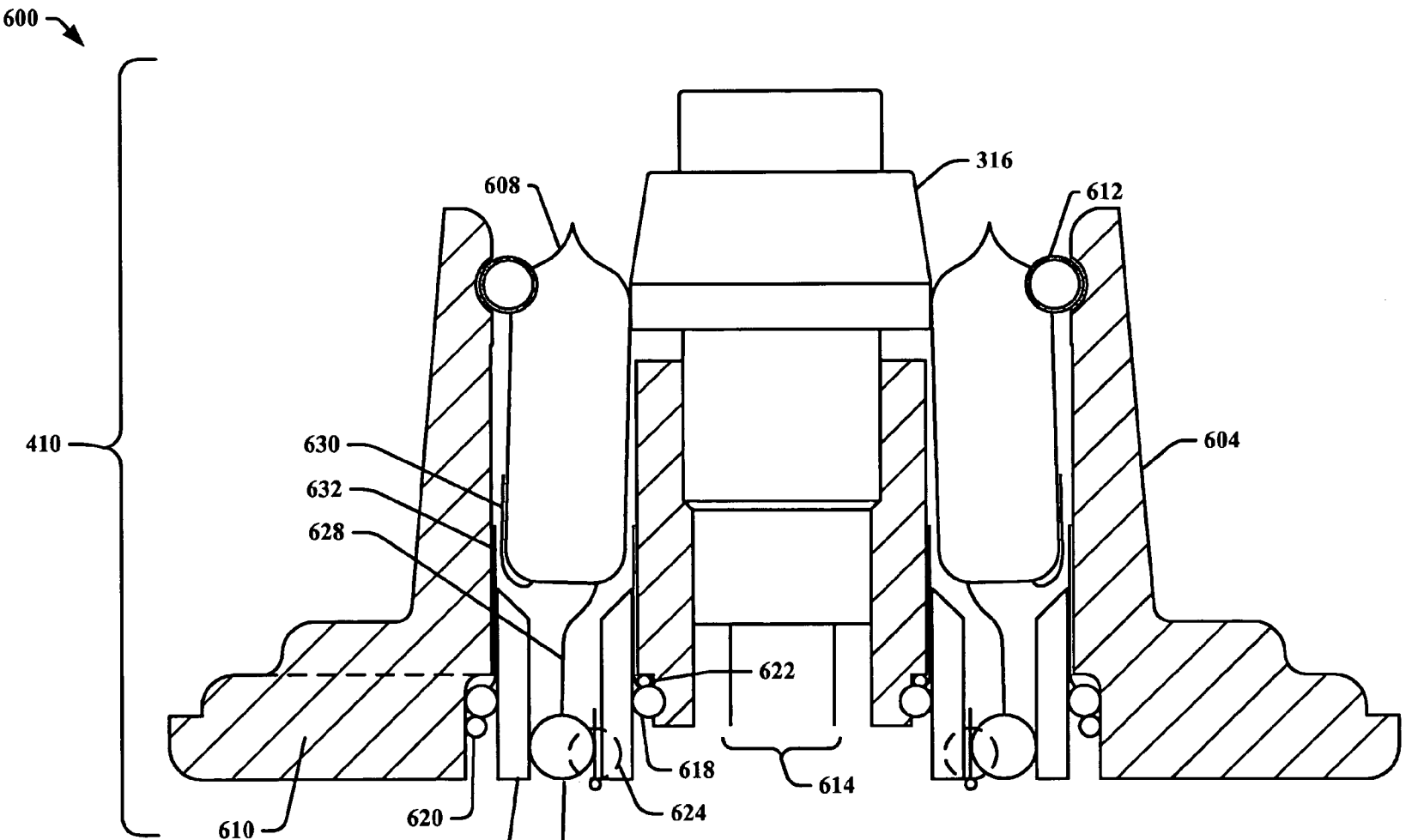
FIG. 6 is a sectional view of an instance of a switch post assembly in accordance with an aspect of an embodiment.

Looking at FIG. 6, a sectional view 600 of an instance of a switch post assembly 410 in accordance with an aspect of an embodiment is illustrated. This instance of the switch post assembly 602 410 is comprised of a switch post 604, a switch mechanism 316, a light source 608, a light source retention device 612, an electrically conductive plug 616, an electrically conductive cylindrical sleeve 632, an electrically inert cylindrical sleeve 626, an insulating ring 618, a first conductive ring 622, and a second conductive ring 620. The switch post 604 can be constructed of translucent and/or opaque materials and the like. Translucent materials can allow more light to emanate from the light source 608 for some instances of the switch post assembly 410. The switch mechanism 316 is typically mounted in the switch post 604 by threading the switch mechanism 316 into the switch post 604.

However, other instances of the switch post assembly 410 can have the switch mechanism 316 "press-fit" into the switch post 604. Press-fit generally implies insertion of an object under pressure such that the inherent properties of materials of each object provide adequate friction to inhibit objects from separating under normal operating conditions. One skilled in the art can appreciate that there are many ways to mount the switch mechanism 316 to the switch post 604, such as "through-bolting" and/or using adhesives and the like, and are within the scope of the subject matter herein.

The switch mechanism 316 can include, but is not limited to, mechanical switches, magnetic switches, and/or electrical switches and the like. The switch mechanism 316 provides continuity control to energize or de-energize an attached electrical device. It 316 typically provides two switch contacts 614 to allow electrical attachment to an electrical cord (not shown). The electrical cord typically passes through a cord channel 610 in the switch post 604 and electrically connects to the switch contacts 614. Other instances of the switch mechanism 606 316 can include multiple switches in a single housing that allow multiple electrical devices to be controlled when activated and, thus, can include more than two switch contacts 614 to interact with more than one electrical device and the like. The switch mechanism 316 can also employ various styles of switch activation plungers including, but not limited to, concave, convex, and/or square style and the like switch activation plungers.

In the instance example illustrated in FIG. 6, the light source 608 is a bulb type light source with two leads. However, the light source 608 can include, but is not limited to, low pressure gas light sources (e.g., neon, krypton, argon, etc.), fluorescent light sources, light emitting diode (LED) light sources, incandescent light sources, and/or self-illumination light sources and the like. A light source with leads typically requires a mounting socket to be provided within the switch post 604. However, other types of light sources 608 do not require such a mounting socket. LEDs can be surface mounted, for example, on top of the switch post 604 and/or mildly recessed into the switch post 604. Similarly, self-illumination sources (e.g., tritium, glow paints, etc.) can be surface mounted and/or surface applied without requiring mounting sockets. Screw-base light sources can also be utilized by providing an appropriate socket within the switch post 604.

In this instance, the light source 608 is retained by the light source retention device 612. This facilitates stabilization of the light source 608 and/or inhibits undesired ejection from the switch post 604 due to orientation of the switch post assembly 410 (e.g., turning the switch post assembly 410 upside down and/or mounting the switch post assembly 410 vertically, etc.). In some instances the light source retention device 612 is not required due to the inherent stability of the type of light source (e.g., LED, glow paint, screw-base bulbs, etc.).

FIG. 6 illustrates a neon bulb with two leads 628, 630 as an example light source 608. The first lead 628 makes electrical contact with the electrically conductive plug 616 which also makes electrical contact with an optional resistive element 624 that is then connected to the second conductive ring 620. The optional resistive element 624 can be utilized to limit current flowing through the light source 608 but is not necessary for some types of light sources. With light sources 608 not requiring the optional resistive element 624 (e.g., resistor and the like), the electrically conductive plug 616 can also make contact with a wire that takes the place of the optional resistive element 624 to connect the first lead 628 to the second conductive ring 620. With a neon bulb type light source 608, the optional resistive element 624 can be a ¼ watt resistor and the like.

The electrically conductive plug 616 is press-fit into the electrically inert cylindrical sleeve 626 while sandwiching a lead from the optional resistive element 624 and/or other wire and the first lead 628 of the light source 608. Thus, there is an electrically conductive path from the first lead 628 to the lead of the optional resistive element 624 and/or other wire via the electrically conductive plug 616. The electrically conductive plug 616 can be spherical, cylindrical, and/or any other shape that provides sufficient pressure to retain electrical leads between the electrically conductive plug 616 and the electrically inert cylindrical sleeve 626. The second lead 630 of the light source 608 is bent upwards and makes electrical contact with the electrically conductive cylindrical sleeve 632.

The electrically conductive cylindrical sleeve 632 is interposed between the switch post 604 and the electrically inert cylindrical sleeve 626. Thus, the electrically inert cylindrical sleeve 626 also functions to inhibit electrical conduction between the first and second leads 628, 630 and/or to provide lower support for the light source 608. The electrically conductive cylindrical sleeve 632 is electrically connected to the first conductive ring 622 which is electrically connected to one of the switch contacts 614. The insulating ring 618 resides around the electrically inert cylindrical sleeve 626 and facilitates in insulating the second conductive ring 620 from the electrically conductive cylindrical sleeve 632 and also isolating and/or retaining the first conductive ring 622.

When the switch post assembly 410 is wired to an electrical cord (not shown), the electrical cord enters the center of the switch post assembly 410 via the cord channel 610 and is electrically connected to the switch mechanism 316 via the switch contacts 614. Typical household wiring in the United States is required to have different sized prong receptacles in a home electrical outlet. Wiring codes require that an alternating current (AC) neutral connection have a larger prong than an AC hot connection. This forces the orientation of a device plugged into the electrical outlet. Thus, a typical instance of the subject matter provided herein utilizes the switch mechanism 316 to switch the neutral connection rather than the hot connection. With this orientation, the first conductive ring 622 provides a hot connection point and the second conductive ring 620 provides a neutral connection point. However, the overall utility and/or functionality of the switch post assembly 410 (and a remote control electrical switch described herein) are generally not affected by the reversing of this orientation.

Figure 7:
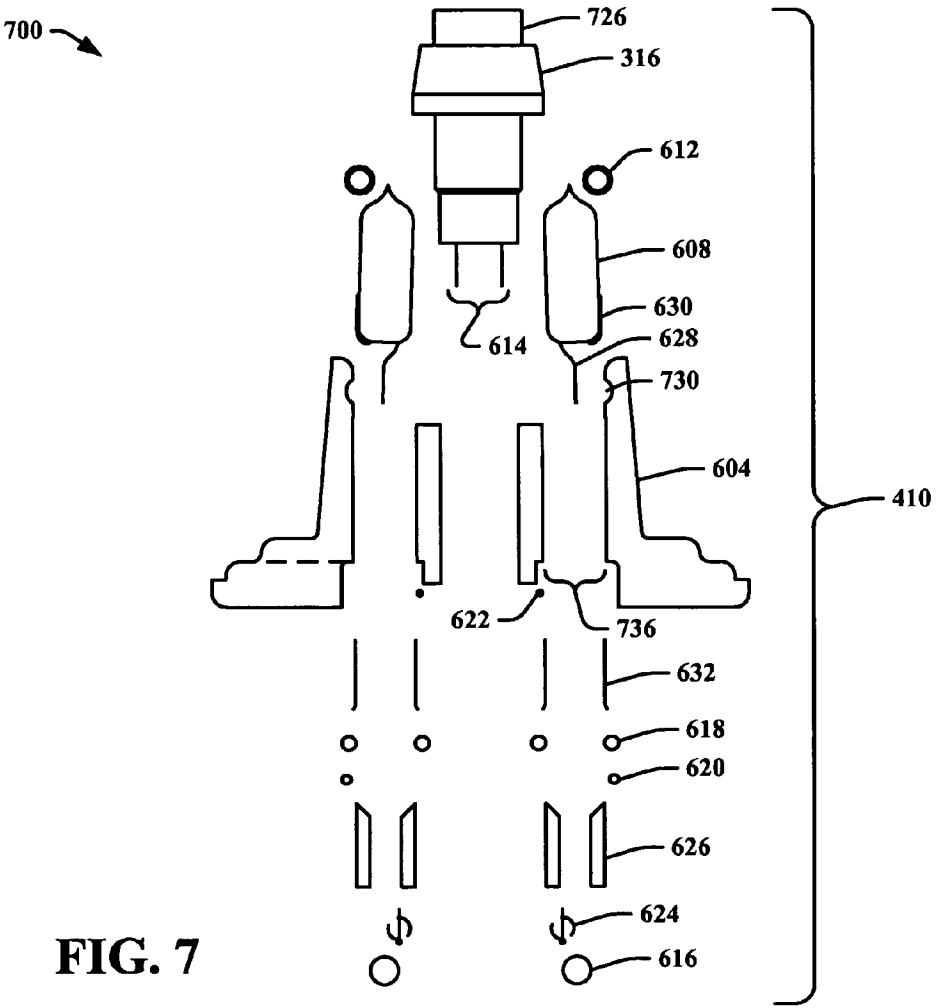
FIG. 7 is an exploded view of an instance of a switch post assembly in accordance with an aspect of an embodiment.

Turning to FIG. 7, an exploded view 700 of an instance of a switch post assembly 410 in accordance with an aspect of an embodiment is shown. A switch mechanism 316 generally has a switch plunger 726 and switch contacts 614. The switch plunger 726 can vary in shape and/or design as noted supra. The rating of the switch mechanism 316 can vary depending on the expected loading of attached electrical devices. In typical instances, a 3A/125 V AC rated ON/OFF non-momentary switch is sufficient for most home lighting and/or small appliance devices. Momentary type switches and/or electronic switches and the like can be utilized as well. The switching quality of the switch mechanism 316 can directly affect the overall user satisfaction with the operation and/or tactile feel of a remote control electrical switch disclosed herein. Thus, high quality switches are generally utilized within the switch post assembly 410 to provide optimum performance and/or user satisfaction.

A light source retention device 612 is typically a semi-rigid tube and/or cylindrical device that can be formed into a circular shape to inhibit separation of a light source 708 from a switch post 604. In one instance, the light source retention device 612 is constructed from vinyl tubing. If the light source 708 generates heat, the light source retention device 612 can be constructed from heat resistant materials and the like. The light source retention device 612 is held in place by a groove 730 in an upper portion of the switch post 604 and its 612 natural tendency to return to its 612 previous shape (i.e., the light source retention device 612 exerts outward pressure on the switch post 604 in the groove 730). The light source 708 makes contact with the light source retention device 612 and inhibits upward movement of the light source 708.

The light source 708 can be, but is not limited to, those types listed supra. In the instance example illustrated in FIG. 7, the light source 708 is a bulb type with a first and second lead 630, 628. A mounting socket 736 is provided in the switch post 604 so that the light source 708 can be recessed into the switch post 604 and held in place. The switch post 604 can be constructed, for example, of translucent materials and the like as described supra to facilitate in allowing light transmission of the light source 708. An electrically conductive cylindrical sleeve 632 is inserted into the mounting socket 736 in a press-fit manner. In some instances, the electrically conductive cylindrical sleeve 632 is constructed from ¼" brass tubing. However, it 632 can be constructed from other conductive materials as well. The electrically conductive cylindrical sleeve 632 functions to facilitate in providing an electrical path from the first lead 630 of the light source 708 to one of the switch contacts 614.

A first conductive ring 622 facilitates this process by providing a common point to attach one or more electrically conductive cylindrical sleeves 632 at a lower end of the electrically conductive cylindrical sleeve 632. In some instances, the electrically conductive cylindrical sleeve 632 is slightly chamfered outward at the lower end to facilitate electrically contacting the first conductive ring 622. In some instances, the first conductive ring 622 is constructed of 0.025" copper wiring. However, the first conductive ring 622 can also be constructed of various sizes and/or electrically conductive compositions and the like. For example, the first conductive ring 622 can be a flat ring of brass as opposed to a round copper wire and the like.

An electrically inert cylindrical sleeve is inserted inside the electrically conductive cylindrical sleeve 632 in a press-fit manner. The electrically inert cylindrical sleeve can be constructed utilizing nonconductive materials such as, for example, polyethylene tubing and the like as described supra. The electrically inert cylindrical sleeve provides electrical isolation between the switch contacts 614 and/or supporting structure for a lower end of the light source 708. It also functions to facilitates in establishing an electrical connection of the second lead 628 of the light source 708 to one of the switch contacts 614. This is accomplished by inserting an electrically conductive plug 616 into the electrically inert cylindrical sleeve, pressing the second lead 628 of the light source 708 against the electrically inert cylindrical sleeve. This extends an electrical pathway from the second lead 628 to the electrically conductive plug 616. A lead from an optional resistive element 624 and/or a wire can also be pressed between the electrically conductive plug 616 and the electrically inert cylindrical sleeve to further the electrical pathway. This is done to provide an electrical pathway to one of the switch contacts 614. The electrically conductive plug 616 can be comprised of various sizes and/or shapes such as, for example, cylindrical and/or spherical and the like as described supra. In some instances, the electrically conductive plug 616 can be comprised of spherical brass material and the like.

An insulating ring 618 can be placed around a lower end of the electrically inert cylindrical sleeve to facilitate isolation of the first conductive ring 622 and/or to insulate a second conductive ring 620 from a lower end of the electrically conductive cylindrical sleeve 632. The insulating ring 618 can be constructed of electrically inert materials such as, for example, rubber and/or plastic and the like. In some instances, for example, the insulating ring 618 is constructed from nitrile compounds in an O-ring configuration and the like. The second conductive ring 620 facilitates to provide a common electrical pathway to one of the switch contacts 614. It 620 typically provides a common contact point for multiple optional resistive elements 624. In some instances, the second conductive ring 620 is constructed of 0.040" copper wire. However, the second conductive ring 620 can also be constructed of various sizes and/or electrically conductive compositions and the like. For example, the second conductive ring 620 can be a flat ring of brass as opposed to a round copper wire and the like.

Figure 8:
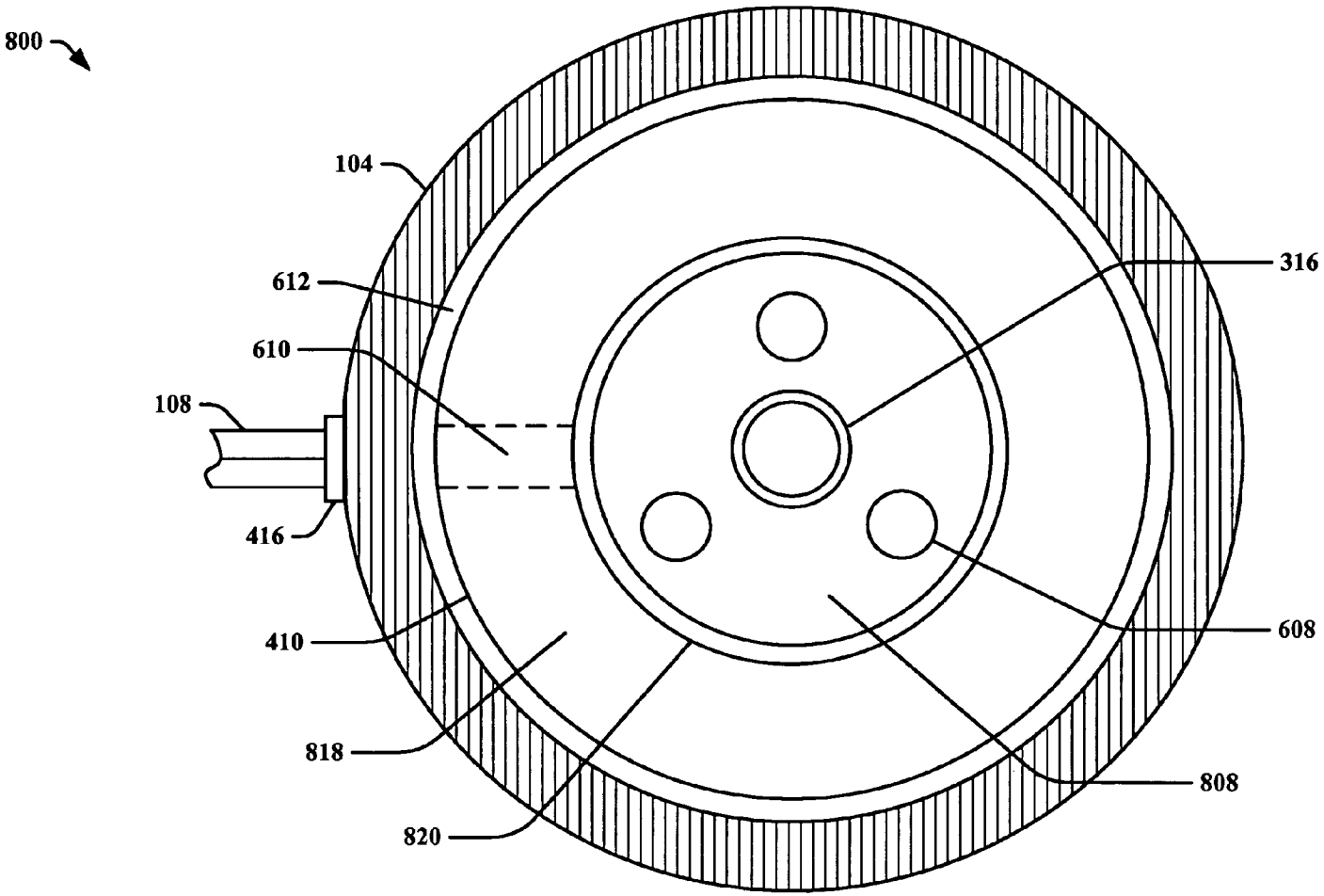
FIG. 8 is a top view of an instance of a switch post assembly mounted in a base in accordance with an aspect of an embodiment is illustrated.

Referring to FIG. 8, a top view 800 of an instance of a switch post assembly 410 mounted in a base 104 in accordance with an aspect of an embodiment is illustrated. The top view 800 also illustrates a light source retention device 612 inserted into a groove in the base 104, an electrical cord 108 with a cord grommet 416 going through the base 104 into the switch post assembly 410. From the top view 800 of this instance, the switch post assembly 410 has a lower base portion 818, an upper portion 820, and a recessed portion 808. The recessed portion 808 facilitates in creating a wall out of part of the upper portion 820. This allows a light source 608 and a switch mechanism 316 to be recessed lower than a top of the upper portion 820. The top view 800 illustrates a three light source configuration. However, other instances can include a single light source and/or other multiples of light sources. The top view 800 also illustrates how the electrical cord 108 enters the switch post assembly 410 without interfering with the light sources and their mounting sockets by running through a channel 610 in the lower base portion 818 of the switch post assembly 410 interposed between the light source mounting sockets.

Figure 9:
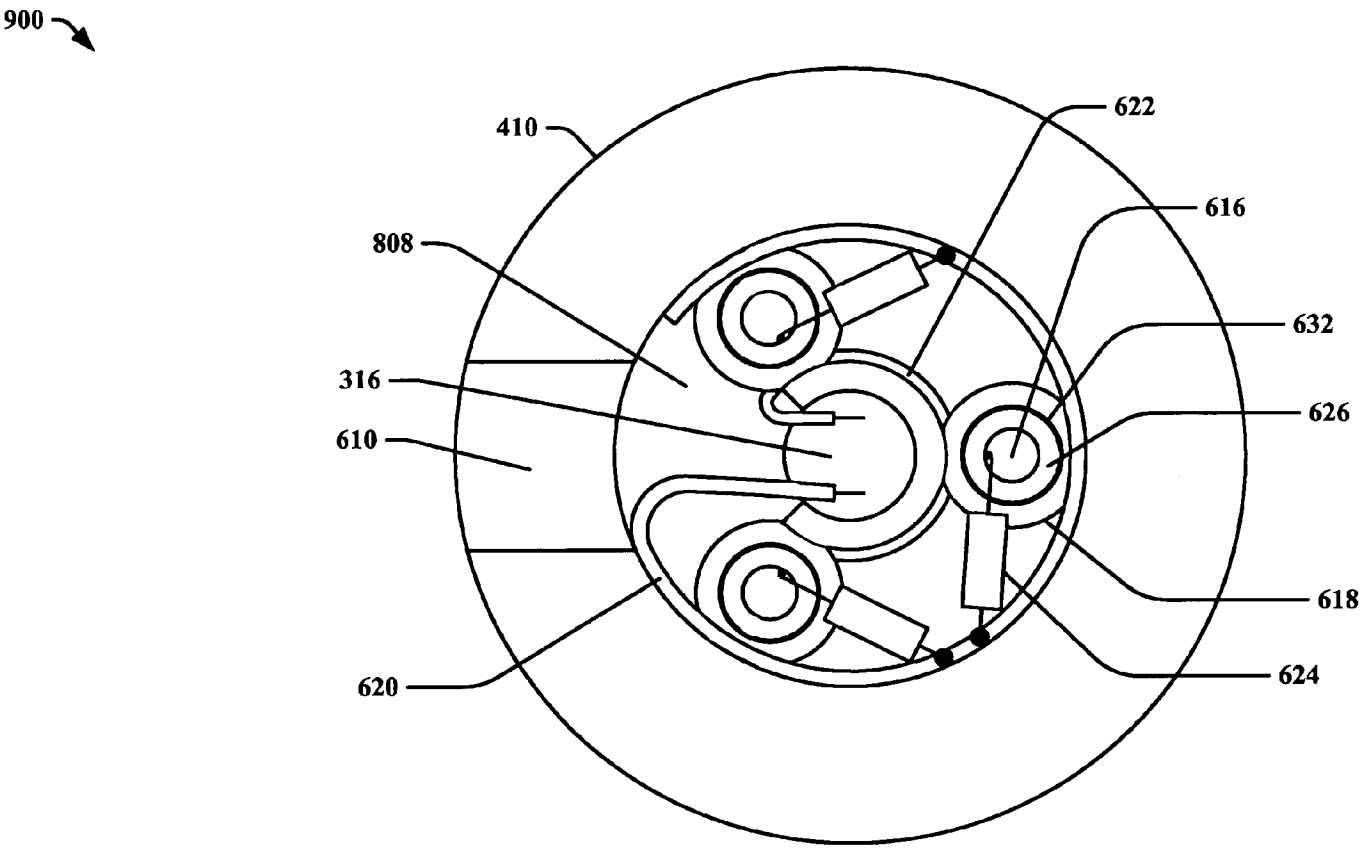
FIG. 9 is a bottom view of an instance of a switch post assembly in accordance with an aspect of an embodiment.

Referring to FIG. 9, a bottom view 900 of an instance of a switch post assembly 410 in accordance with an aspect of an embodiment is illustrated. A cord channel 610 allows an electrical cord to enter the switch post assembly 410 to connect to a switch mechanism 316. A first conductive ring 622 is connected to the switch mechanism 316 and circumnavigates the switch mechanism 316. The first conductive ring 622 provides a common conductive point to connect an electrically conductive cylindrical sleeve 632 which is electrically connected to a lead of a light source, to a contact of the switch mechanism 316.

A second conductive ring 620 is connected to another contact of the switch mechanism 316 and circumnavigates a recessed cavity 922 in a base portion of the switch post assembly 410. The second conductive ring 620 provides a common conductive point to connect, for example, a resistive element 624 and/or a wire to another contact of the switch mechanism 316. The resistive element 624 and/or wire are typically also electrically connected to another lead of the light source via an electrically conductive plug 616 that holds leads from the resistive element 624, wire, and/or light source in an electrically inert cylindrical sleeve 626. The recessed cavity 922 allows electrical connections to be made in the base portion of the switch post assembly 410 so that the switch post assembly 410 can be mounted flush inside the bottom of a base of a remote control electrical switch. An insulating ring 618 that surrounds the electrically inert cylindrical sleeve 626 facilitates to isolate the first conductive ring 622 and/or to insulate the electrically conductive cylindrical sleeve 632 from the second conductive ring 620.

The first and second conductive rings 620, 622 allow for quicker assembly of the switch post assembly 410 and/or reduce excess wire and the like. This allows a safer product to be manufactured more easily, reducing costs and increasing user safety. The utilization of the electrically conductive plug 616 also facilitates ease of assembly without requiring complicated soldering of light source leads and the like. This also allows for easy maintenance of the switch post assembly 410 such as, for example, replacing light sources and the like without requiring specialized tools and/or soldering equipment and the like, significantly reducing repair time and/or costs.

Figure 10:
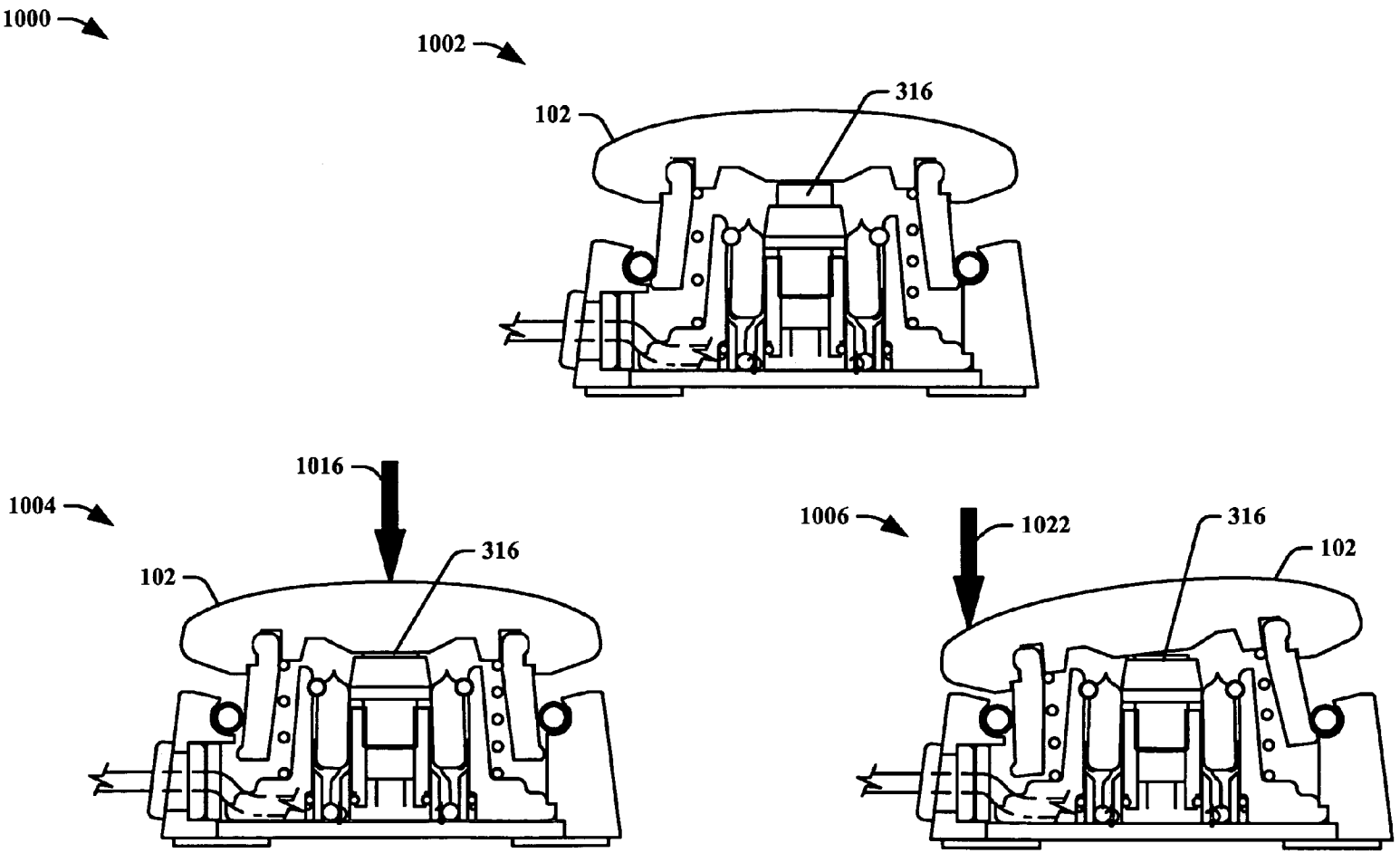
FIG. 10 is an illustrative example of switch activation for an instance of a remote control electrical switch in accordance with an aspect of an embodiment.

In FIG. 10, an illustrative example 1000 of switch activation for an instance of a remote control electrical switch in accordance with an aspect of an embodiment is depicted. An "at rest" remote control electrical switch 1002 is shown at rest with no force applied to its pivotable switch actuator cap 102. A switching mechanism 316 is shown to be at full extension. A "centrally activated" remote control electrical switch 1004 is shown after a force 1016 has been applied in substantially a center point of a pivotable switch actuator cap 102. Note that a switch mechanism 316 is fully depressed, activating the switch mechanism 316. An "off-center activated" remote control electrical switch 1006 is shown after a force 1022 has been applied at an off-center point of a pivotable switch actuator cap 102 . A switch mechanism 316 is fully depressed, activating the switch mechanism 316. Thus, instances of a remote control electrical switch disclosed herein can be activated without requiring exact placement of a force on a pivotable switch actuator cap. This, along with a 360 degree approach, allows the remote control electrical switch to function effortlessly to remotely control electrical devices. The large actuation surface of the pivotable switch actuator cap allows activation using minimal motor skills. This is especially beneficial to those with disabilities and the elderly.

Figure 11:
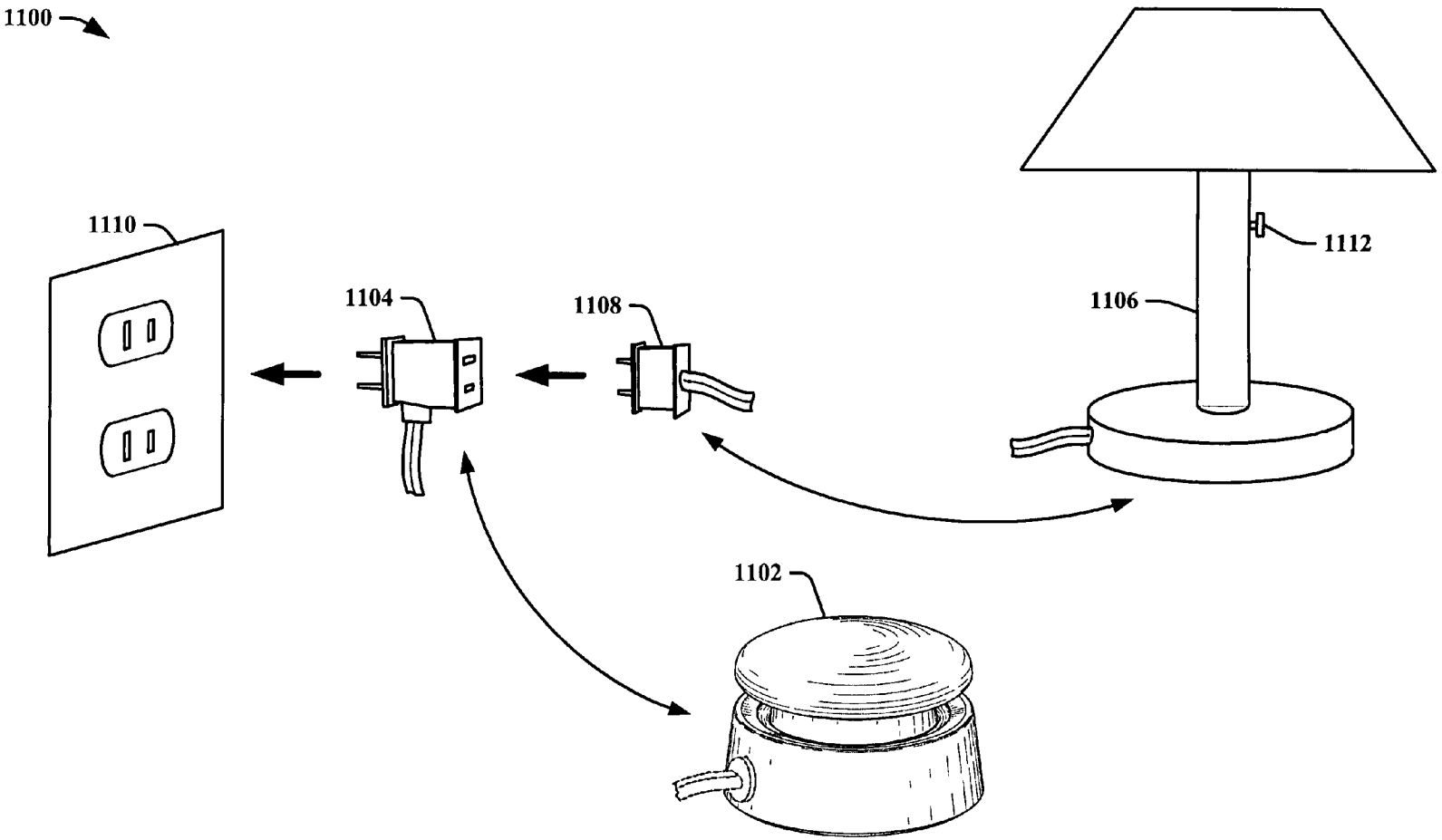
FIG. 11 is an illustrative example of connecting an instance of a remote control electrical switch to an electrical device in accordance with an aspect of an embodiment.

Looking at FIG. 11, an illustrative example 1100 of connecting an instance of a remote control electrical switch 1102 to an electrical device 1106 in accordance with an aspect of an embodiment is depicted. In this instance, the remote control electrical switch 1102 has a "piggy-back" style plug 1104 which a plug 1108 from the electrical device 1106 plugs into. The piggy-back style plug 1104 is then plugged into an electrical outlet 1110. It is common for some types of electrical devices to have a control switch 1112. This control switch 1112 is typically engaged in an energized state (e.g., "ON," etc.) to allow electrical energy to flow through the electrical device 1106 when the remote control electrical switch 1102 is activated. The piggy-back style plug 1104 allows the remote control electrical switch 1102 to be serially connected to the electrical device 1106. Thus, for the electrical device 1106 to operate, the remote control electrical switch 1102 has to be activated.

By employing the piggy-back style plug 1104, the remote control electrical switch 1102 can be easily utilized to control a variety of electrical devices including, but not limited to, lamps, fans, and/or televisions and the like. The remote control electrical switch 1102 can also be utilized to control multiple electrical devices. One instance of accomplishing this is to utilize a multiple outlet style plug to plug into the piggy-back style plug 1104. Electrical devices then plugged into the multiple outlet style plug are then controlled by the remote control electrical switch 1102. Although the piggy-back style plug 1104 provides an easy solution to connecting the electrical device 1106 without modifications, one skilled in the art can appreciate that other mechanisms can be employed to connect to the remote control electrical switch 1102 in a serial manner, including, but not limited to, hardwiring and the like, and are within the scope of the subject matter herein.

Figure 12:
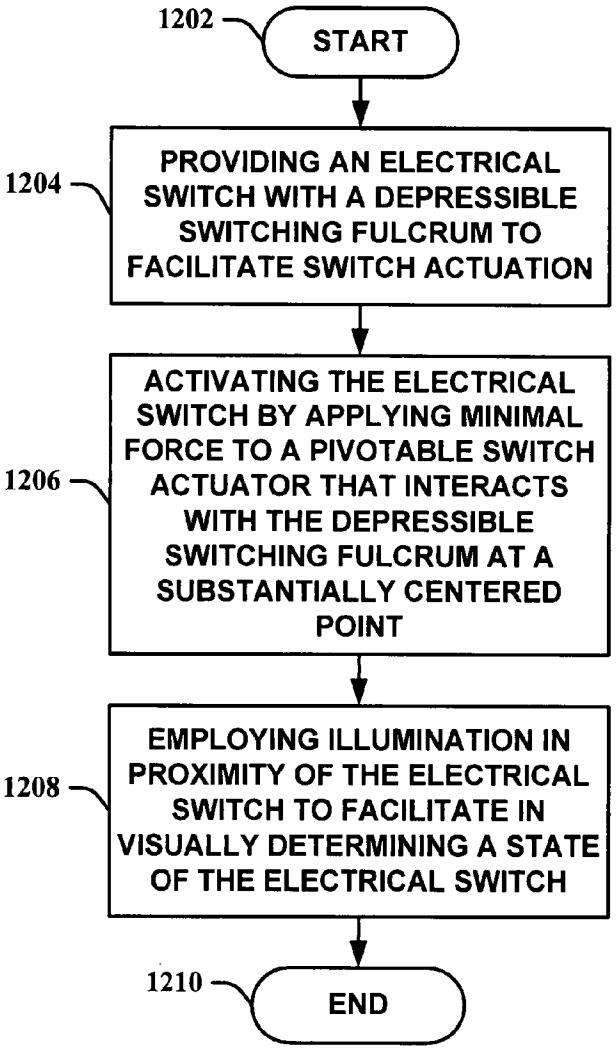
FIG. 12 is a flow diagram of a method of facilitating remote switching of electrical devices in accordance with an aspect of an embodiment.

In view of the exemplary apparatus shown and described above, methodologies that may be implemented in accordance with the embodiments will be better appreciated with reference to the flow chart of FIG. 12. While, for purposes of simplicity of explanation, the methodologies are shown and described as a series of blocks, it is to be understood and appreciated that the embodiments are not limited by the order of the blocks, as some blocks may, in accordance with an embodiment, occur in different orders and/or concurrently with other blocks from that shown and described herein. Moreover, not all illustrated blocks may be required to implement the methodologies in accordance with the embodiments.

In FIG. 12, a flow diagram of a method 1200 of facilitating remote switching of electrical devices in accordance with an aspect of an embodiment is shown. The method 1200 starts 1202 by providing an electrical switch with a depressible switching fulcrum to facilitate switch actuation 1204. The depressible switching fulcrum is not required to be substantially a point fulcrum. Rounded and even flat depressible switching fulcrums are acceptable and function appropriately. A depressible switching fulcrum is essentially a fulcrum that can be depressed to activate a switch with or without leverage. One skilled in the art can appreciate the wide range of devices that can be utilized as a depressible switching fulcrum including heat, pressure, and/or mechanical switch devices and are within the scope of the subject matter herein.

The electrical switch is then activated by applying minimal force to a pivotable switch actuator that interacts with the depressible switching fulcrum at a substantially centered point 1206. The pivotable switch actuator allows interaction with the depressible switching fulcrum in an omnidirectional manner. This allows the electrical switch to be activated with limited motor skills, providing easy activation to those with disabilities, the elderly, and/or children and the like. Illumination in proximity of the electrical switch is then employed to facilitate in visually determining a state of the electrical switch 1208, ending the flow 1210. The illumination can be provided by a light source in direct and/or indirect contact with the electrical switch and/or the pivotable switch actuator; Thus, the pivotable switch actuator can mechanically induce the illumination and/or the illumination can be triggered by the electrical switch and the like. The illumination can emanate from a light source such as a gas excitation source, an incandescent source, a fluorescent source, a self-illumination source, and/or an LED source and the like.

What has been described above includes examples of the embodiments. It is, of course, not possible to describe every conceivable combination of components or methodologies for purposes of describing the embodiments, but one of ordinary skill in the art may recognize that many further combinations and permutations of the embodiments are possible. Accordingly, the subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparatus for remote control of an electrical device, comprising:
- an electrical switch that provides a depressible switching fulcrum to facilitate switch actuation;
- a base that provides a switch mounting area for the electrical switch;
- a pivotable switch actuator cap that interacts with the depressible switching fulcrum at a substantially centered point, the switch actuator cap is substantially perpendicular to the electrical switch center axis when at rest and activates the electrical switch when a force is applied to the pivotable switch actuator cap;
- a connecting ring that is connected to the switch actuator cap and retained by the base to facilitate centering the switch actuator cap and the base; and
- a connecting ring retention device located near a top portion of the base that allows the connecting ring to move within the base while substantially inhibiting separation of the base and the connecting ring.

2. The apparatus of claim 1, the pivotable switch actuator cap provides omnidirectional activation of the electrical switch.

3. The apparatus of claim 1, the pivotable switch actuator cap is comprised of, at least in part, translucent material.

4. The apparatus of claim 1, the base is comprised of, at least in part, translucent material.

5. The apparatus of claim 1, the pivotable switch actuator cap provides a switch actuation surface area that is substantially equal in size to a diameter of the base.

6. The apparatus of claim 1, further comprising:
- a pad affixed to the base to facilitate in inhibiting undesired movement of the apparatus.

7. The apparatus of claim 1, further comprising:
- a spring that applies opposing forces to the switch actuator cap and the base and resides within the connecting ring and the base, the spring providing a rebounding force to the switch actuator cap after switch activation by a user.

8. The apparatus of claim 1, the connecting ring comprising a ring constructed, at least partially, of translucent material.

9. The apparatus of claim 8, the connecting ring contains translucent shapes and/or symbols.

10. The apparatus of claim 8, further comprising:

at least one light source that transmits light through at least a portion of the connecting ring.

11. The apparatus of claim 10, the light source provides 360 degrees of illumination.

12. The apparatus of claim 10, the light source comprising at least one neon light source.

13. The apparatus of claim 10, the light source comprising at least one light emitting diode (LED) source.

14. The apparatus of claim 10, the light source indicates an operational state of the electrical switch.

15. The apparatus of claim 14, the light source is energized when a controlled device is energized and is de-energized when a controlled device is de-energized.

16. The apparatus of claim 1, further comprising:

a switch post interposed between the base and the electrical switch to provide a mount for the electrical switch to the base.

17. The apparatus of claim 16, the switch post containing at least one light source mounting socket.

18. The apparatus of claim 17, the mounting socket comprising:

a substantially cylindrical hole substantially parallel to a central axis of the switch post;

an electrically conductive cylindrical sleeve that resides within the cylindrical hole and provides a first electrical path for a first electrical contact of a light source;

an electrically inert cylindrical sleeve that resides within the conductive cylindrical sleeve and restricts electrical contact with the first electrical path; and an electrically conductive plug that resides within the inert cylindrical sleeve in a press-fit manner to provide an electrical connection of a second electrical contact of the light source to a second electrical path.

19. The apparatus of claim 18, the electrically conductive plug comprising a spherically-shaped plug.

20. The apparatus of claim 18, the electrically conductive plug comprising a cylindrically-shaped plug.

21. The apparatus of claim 18, further comprising:

a first conductive ring that resides within a cylindrical cavity at a base portion of the switch post and provides a common electrical path for first electrical contacts of at least one light source to a first electrical contact of the electrical switch.

22. The apparatus of claim 18, further comprising:

a second conductive ring that resides within a cylindrical cavity at a base portion of the switch post and provides a common electrical path for a second electrical contact of at least one light source to a second electrical contact of the electrical switch.

23. The apparatus of claim 22, further comprising:

an insulating ring that encircles a portion of the electrically inert cylindrical sleeve that protrudes into the cylindrical cavity of the base portion of the switch post and facilitates in isolating electrical paths from interacting with the electrically conductive cylindrical sleeve.

24. A system for interrupting electrical power to an electrical device from a remote location that employs the apparatus of claim 1.

25. A remote lamp switch employing the apparatus of claim 1.

26. A tabletop light remote control device employing the apparatus of claim 1.

27. An apparatus for controlling appliances and/or lighting devices without requiring typical user dexterity, comprising:

an electrical switch that provides a depressible switching fulcrum to facilitate switch actuation;

a base that provides a switch mounting area for the electrical switch;

a switch post interposed between the base and the electrical switch to provide a mount for the electrical switch to the base;

a pivotable switch actuator cap that provides omnidirectional electrical switch activation and interacts with the depressible switching fulcrum at a substantially centered point, the switch actuator cap is substantially perpendicular to the electrical switch center axis when at rest and activates the electrical switch when a force is applied to the pivotable switch actuator cap;

a tapered cylindrical connecting ring that is connected to the pivotable switch actuator cap and retained by the base to facilitate centering the pivotable switch actuator cap and the base;

a tapered cylindrical connecting ring retention device located near a top portion of the base that allows the ring to move within the base while substantially inhibiting separation of the base and ring;

a spring that applies opposing forces to the switch actuator cap and the base and resides within the tapered cylindrical connecting ring and the base, the spring providing a rebounding force to the switch actuator cap after switch activation by a user; and at least one light source that transmits omnidirectional light through at least a portion of the tapered cylindrical connecting ring, the light source mounted within the switch post.

* * * * *